United States Patent [19]

Barnes

[11] 4,126,297

[45] Nov. 21, 1978

[54] MANHOLE COVER LIFTING KEY

[76] Inventor: Frederick J. Barnes, 3 Luth Ave., Daglish, Western Australia, Australia

[21] Appl. No.: 852,357

[22] Filed: Nov. 17, 1977

[51] Int. Cl.[2] ..... B66F 11/00

[52] U.S. Cl. ..... 254/131

[58] Field of Search ..... 214/370, 384; 254/8 R, 254/120, 131

[56] References Cited

U.S. PATENT DOCUMENTS

| | | | |
|---|---|---|---|
| 2,249,603 | 7/1941 | Elkington | 254/131 |
| 3,275,299 | 9/1966 | Meshew | 254/131 |
| 3,362,684 | 1/1968 | Davenport | 254/131 |

*Primary Examiner*—Robert C. Watson

*Attorney, Agent, or Firm*—Harness, Dickey & Pierce

[57] ABSTRACT

A lever for lifting manhole covers comprising a foot, a key adapted to engage a keyhole in a manhole cover, said key being pivotally mounted on one end of the foot, a first roller mounted on the foot inwardly of the other end thereof for rotation about an axis transverse to the longitudinal axis of the foot, a second roller mounted on the foot adjacent the other end thereof for rotation about an axis parallel to the axis of rotation of the first roller, the rollers being located relative to each other so that they function as a rolling fulcrum, the first roller functioning initially as a pivot for lifting the manhole cover and the second roller functioning as a trolley to enable the lifted cover to be transported and an operating lever one end of which is connected to the foot adjacent said one end with the lever projecting at an angle therefrom.

8 Claims, 11 Drawing Figures

MANHOLE COVER LIFTING KEY

This invention relates to a lever for lifting manhole covers.

In the past, manhole covers have been found to be extremely difficult to lift and manoeuvre. Due to the weight of the covers, the fact that when initially fitted there is very little clearance between the actual cover and the supporting side frames, and the continual traffic flow over the cover, they almost become fused or corroded into position. The abnormally tight or "frozen" manhole covers produce difficulties when attempts are made to lift them and Operators using inadequate lifting equipment are very likely to either strain or injure themselves in the lifting process.

One of the objects of this invention is to produce a manhole cover lifting device which is capable of breaking the seal of the cover and lifting the cover without any excessive strain being transferred to the operator.

In one form the invention resides in a lever for lifting manhole covers comprising a foot, a key adapted to engage a keyhole in a manhole cover, said key being pivotally mounted on one end of the foot, a first roller mounted on the foot inwardly of the other end thereof for rotation about an axis transverse to the longitudinal axis of the foot, a second roller mounted on the foot adjacent the other end thereof for rotation about an axis parallel to the axis of rotation of the first roller, the rollers being located relative to each other so that they function as a rolling fulcrum, the first roller functioning initially as a pivot for lifting the manhole cover and the second roller functioning as a trolley to enable the lifted cover to be transported and an operating lever one end of which is connected to the foot adjacent said one end with the lever projecting at an angle therefrom.

The invention will be better understood by reference to the description of two specific embodiments as shown in the accompanying drawings, wherein.

Figure 1:
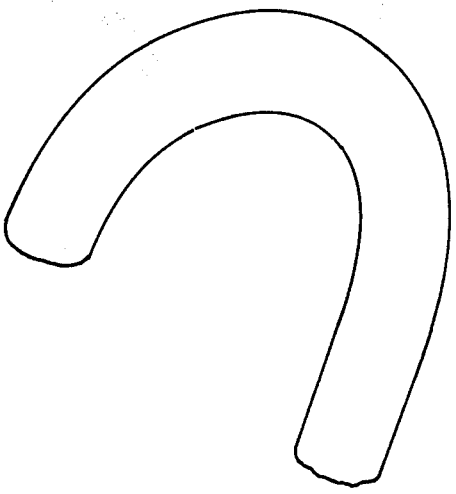
FIG. 1 is a perspective view of one embodiment of the invention.
Figure 1:
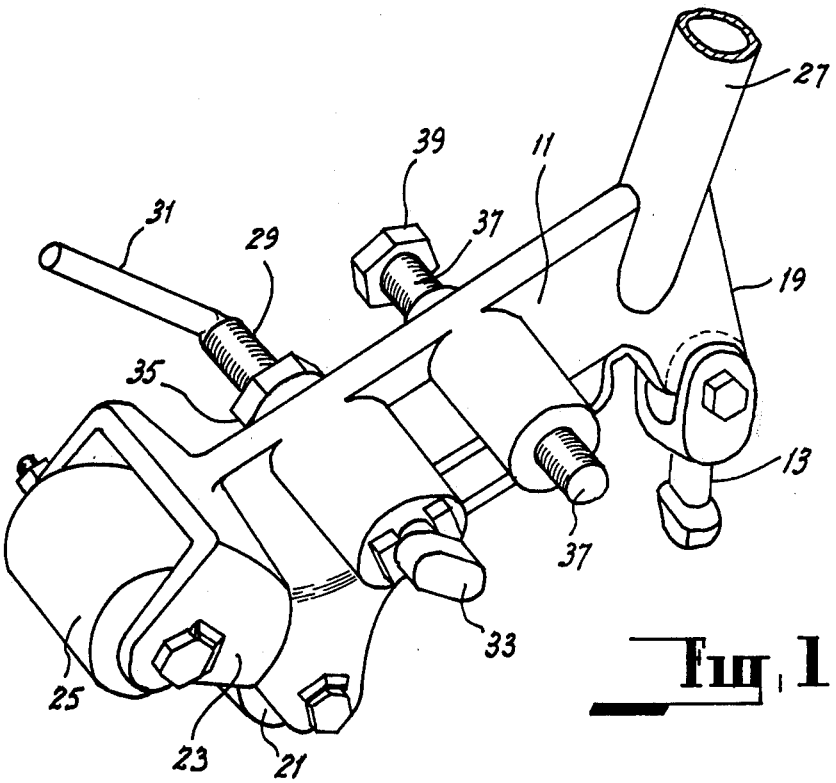
Figure 2:
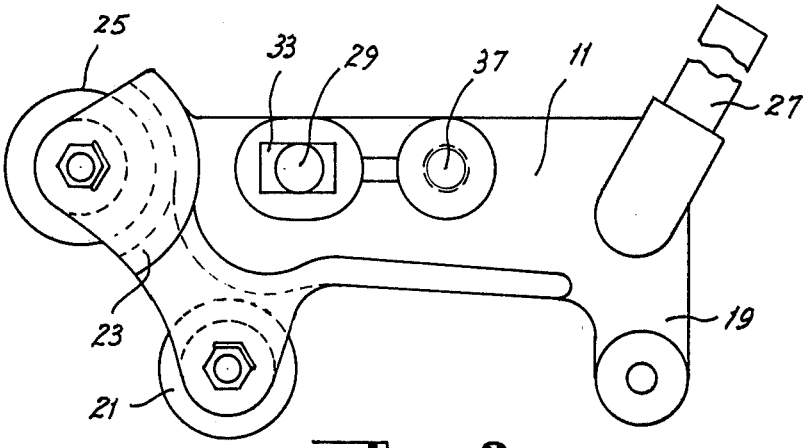
FIG. 2 is a side elevational view of the invention shown in FIG. 1 with the clevis pin or lifting key removed.
Figure 3:
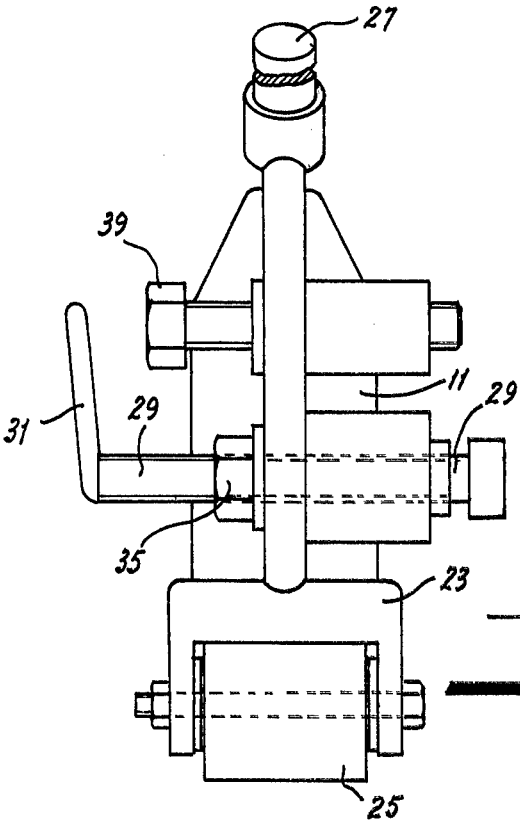
FIG. 3 is a plan view of FIG. 1.
Figure 4:
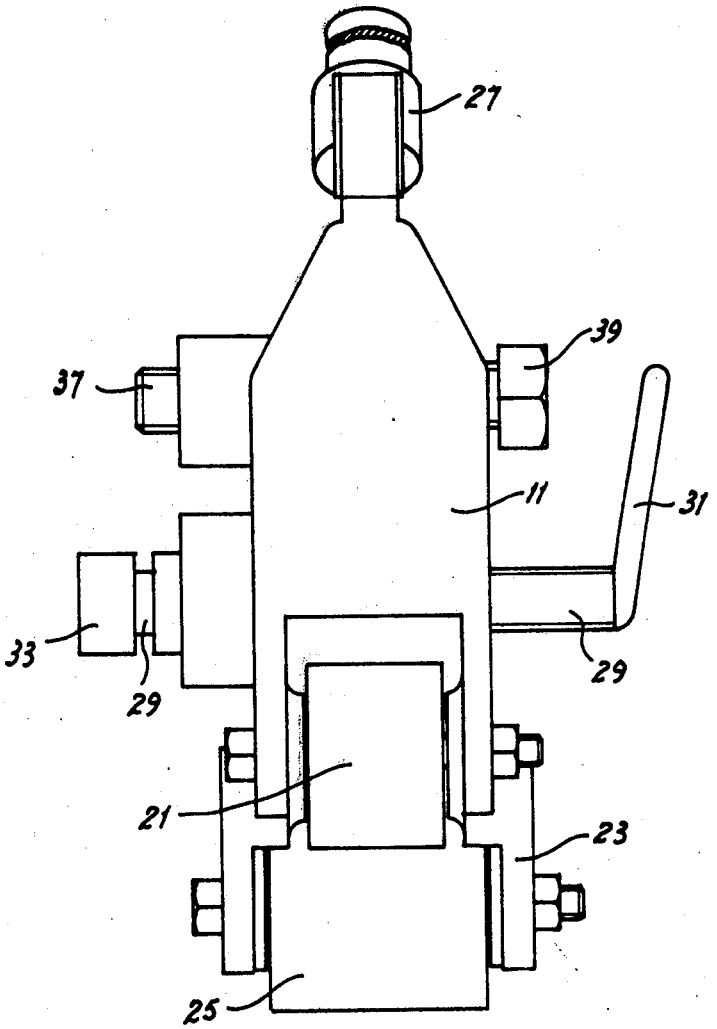
FIG. 4 is an inverted plan view of FIG. 3.

In the first embodiment shown in FIGS. 1–6, a lever for lifting manhole covers is constructed comprising a foot 11 and a key 13 adapted to engage a keyhole 15 in a manhole cover 17. The key 13 is pivotally mounted on one end 19 of the foot 11. A first roller 21 is also mounted on the foot 11 inwardly of the other end 23 thereof. The first roller 21 is mounted for rotation about an axis transverse to the longitudinal axis of the foot 11. A second roller 25 is also mounted on the foot 11, adjacent the other end 23 and for rotation about an axis parallel to the axis of rotation of the first roller 21. The rollers 21 and 25 being located relative to each other as shown in the drawings so that they may function as a rolling fulcrum. An operating lever 27 is connected to end 19 of the foot 11 and projects at an angle therefrom.

Preferably the lifting lever is provided on the central portion of the foot 11 with a jacking device to break the seal of manhole covers. The jacking device consists of two devices one being an adjustable tee bolt 29, the longitudinal axis of which is transverse to the longitudinal axis of the foot 11. One end of the tee bolt 29 being provided with a handle 31 whilst the other end is provided with a short transverse key 33 for engaging the manhole covers. A locking nut 35 is provided on the longitudinal shaft of tee bolt 29. The other device comprises a screw or jack member 37 positioned parallel and adjacent to tee bolt 29. The head or adjusting nut 39 of said jack 37 being on the same side of foot 11 as handle 31 of the tee bolt 29.

Figure 5:
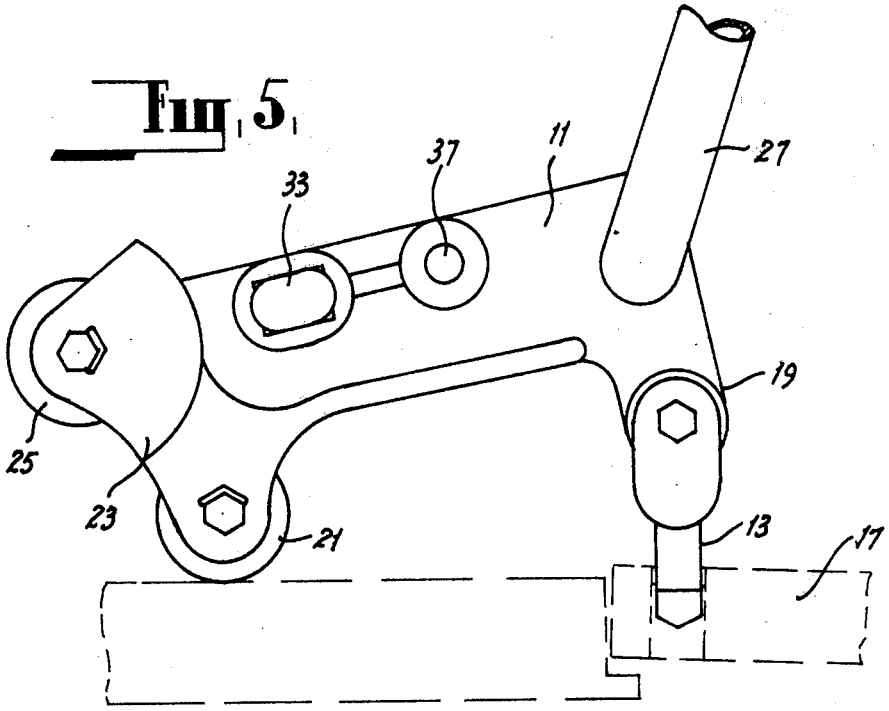
FIG. 5 is a side elevational view showing the clevis pin in use.
Figure 6:
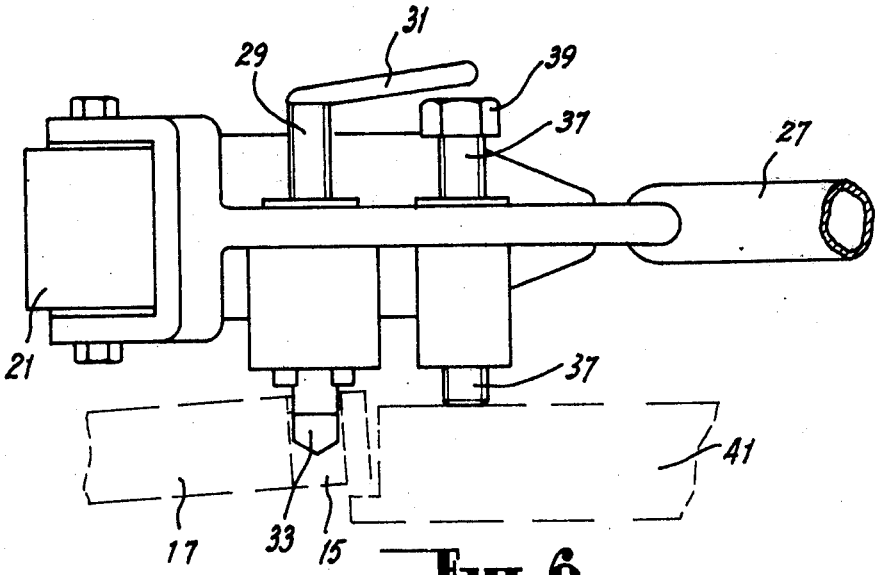
FIG. 6 is a perspective view of the first embodiment of the invention in use to break the seal of a manhole cover.
Figure 7:
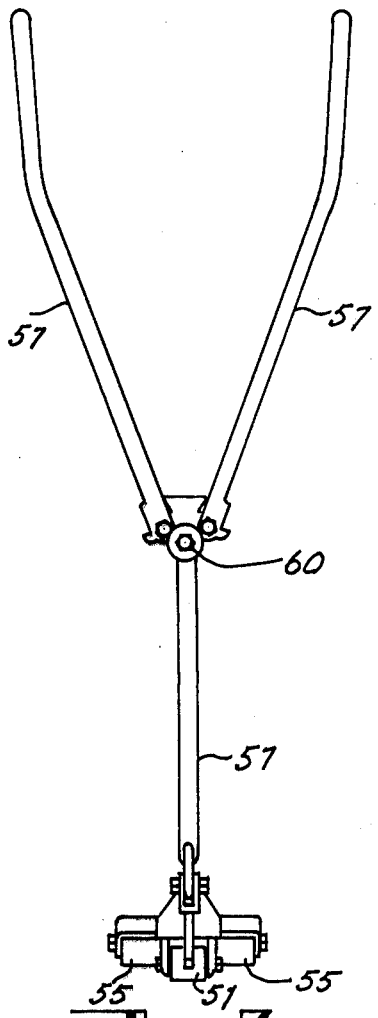
FIG. 7 is a plan view of a second embodiment of the invention.
Figure 8:
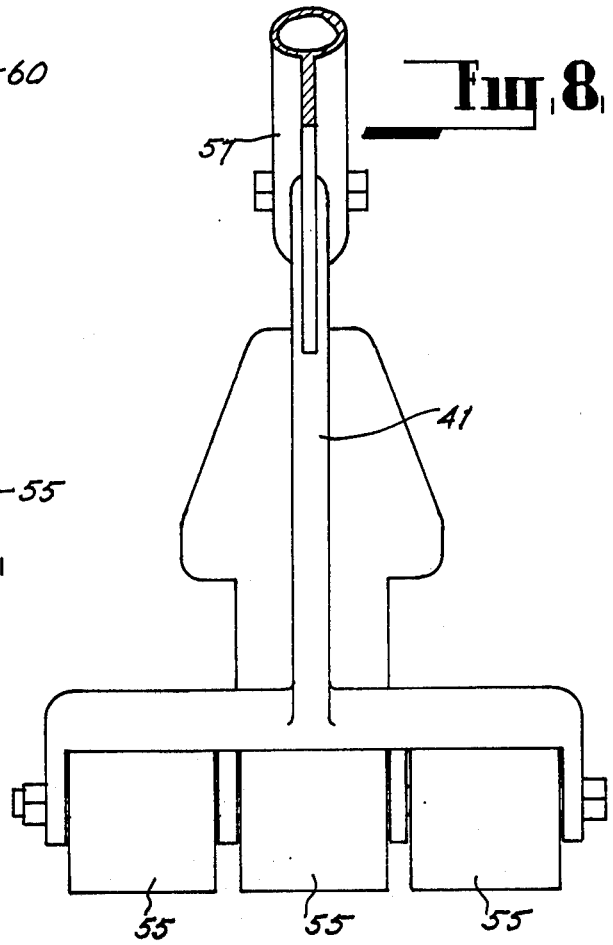
FIG. 8 is a front elevational view of FIG. 7.

In operation, the seal of tight manhole covers must first of all be broken before it is possible to lift and remove the cover itself. This is carried out by turning the lever on its side as shown in FIG. 6 of the drawings and loosening locking nut 35 to enable key 33 to be inserted into keyhole 15 of manhole cover 17. Handle 31 is then given a quarter turn to positively engage key 33 in the keyhole 15. Locking nut 35 is then tightened to ensure that a manhole cover remains in an engaged situation. Adjusting nut 39 of the screw or jack member 37 is turned in a clockwise direction and a downward pressure is applied to the side frame 41 of the manhole cover 17. This has the effect of partially lifting key 33 and so breaking the seal surrounding the cover 17. In order to release the lifting lever, the reverse procedure is carried out. To now lift the relatively free manhole cover 17 the lifting lever is placed in position as shown in FIG. 5 of the drawings. The clevis pin or key 13 is placed into the elongated keyhole 15 and given a quarter turn to lock it in position. With roller 21 acting as a fulcrum, the operator takes hold of handle 27 and pulls it in a backward and downward direction away from said manhole cover 17. This action raises the cover 17. Further lifting of the cover 17 brings roller 25 into contact with the ground and together with roller 21 forms a trolley to enable the lifted cover 17 to be transported.

In order to obtain stability and maximum lift the lifting levers are used in pairs with the operator controlling and operating one in each hand during the actual lifting and conveying process. Obviously where a cover is relatively free there is no need to carry out the procedure shown in FIG. 6 of the drawings.

FIGS. 1–6 of the drawings show one embodiment of the invention where the invention is used in pairs. Whilst this is extremely successful it is also possible to remove manhole covers with one device as described in the second embodiment and shown in FIGS. 7–11 of the drawings.

Figure 9:
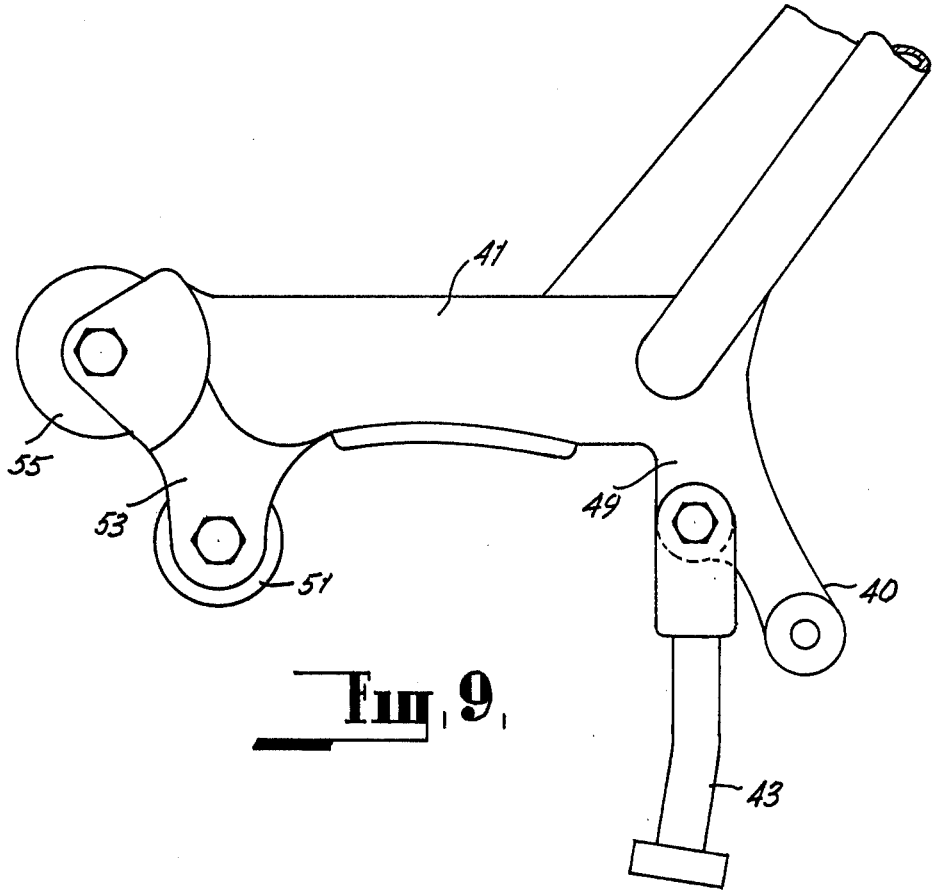
FIG. 9 is a side elevational view of FIG. 7.
Figure 10:
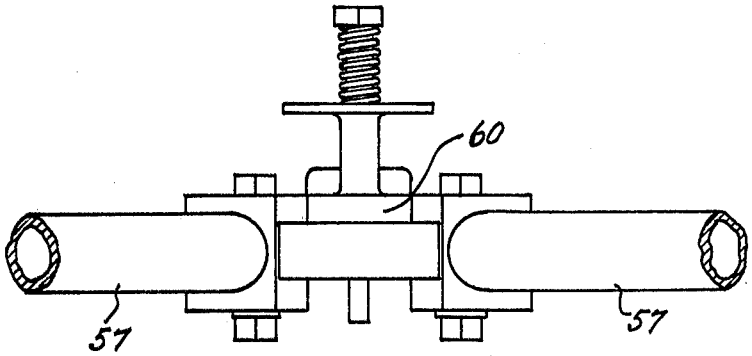
FIG. 10 is a plan view of the hinging mechanism on the operating lever of the second embodiment.

In this second embodiment the priciples of lifting a manhole cover are the same as disclosed with respect to FIGS. 1–6 except that in this instance it is possible to carry out such a function with only one lifting device. The lever for lifting manhole covers is constructed comprising a foot 41 and a key 43 adapted to engage a keyhole 45 in a manhole cover 47. The key 43 is pivotally mounted on one end 49 of the foot 41. An outwardly projecting heel 40 is provided on the end 49 as shown in FIG. 9. A first roller 51 is also mounted on the foot 41 inwardly of the other end 53 thereof. The first roller 51 is mounted for rotation about an axis transverse to the longitudinal axis of the foot 41. A plurality of second rollers 55 are also mounted on the foot 41, adjacent the other end 53 and for rotation about an axis parallel to the axis of rotation of the first roller 51. The rollers 51 and 55 being located relative to each other as shown in the drawings so that they may function as a rolling fulcrum. An operating lever 57 is connected to end 49 of the foot 41 and projects at an angle therefrom. The operating lever shown in FIG. 7 of the drawings is "Y" or yoke shaped and provided with a suitable hinge mechanism 60.

Figure 11:
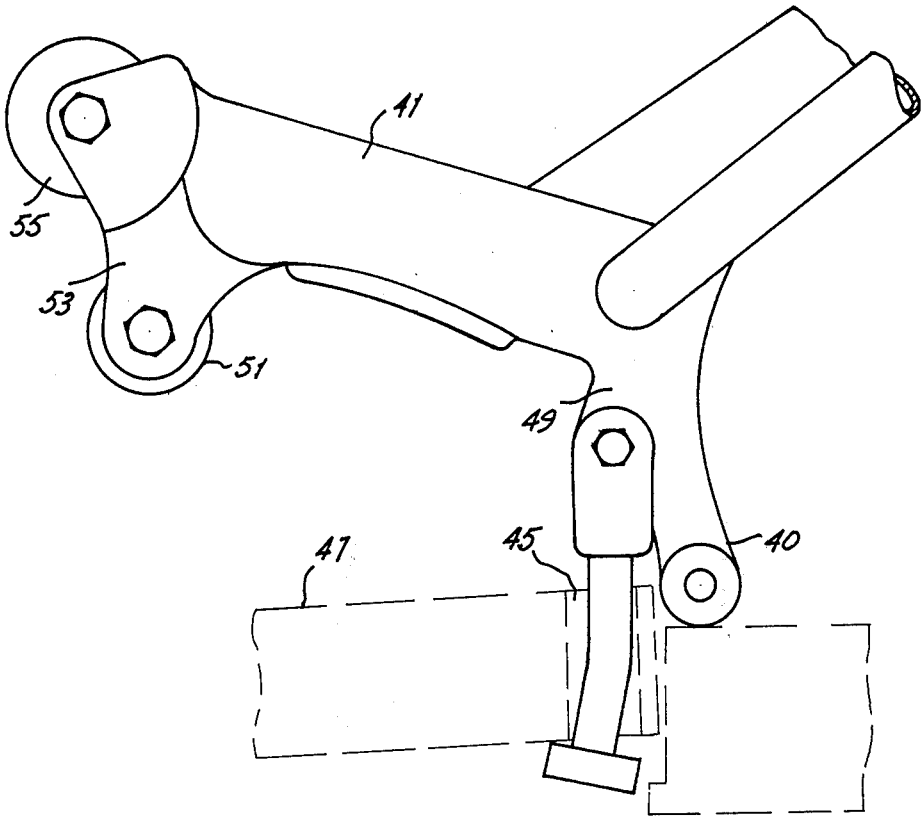
FIG. 11 is a perspective view of the second embodiment in use to break the seal of a manhole cover.

In operation of this second embodiment, the seal of tight manhole covers must first of all be broken before it is possible to lift and remove the cover 47 itself. This is carried out by inserting key 43 into keyhole 45 and pivoting the lifting device on its heel 40 as shown in FIG. 11 of the drawings. The heel 40 obviously resting on the surrounding framework and not on the cover 47 itself. Once the seal surrounding the cover 47 has been broken, the manhole cover lifting device is rotated 180° and the cover 47 is removed in exactly the same manner as described with respect to the first embodiment. With the aid of two or more secondary rollers 55 it is possible to pivot the raised manhole cover 47 to the side or alternatively roll it rearwardly on rollers 55 and 51. When the manhole cover lifting device is not in use the hinge mechanism is unlocked or released so that the upper portions of the lever 57 are able to move away from each other to lie in a folded position parallel to the fixed lower portion of lever 57. This therefore means that for transportation and packaging less area is occupied by the manhole cover lifter.

Whilst the invention has been described with reference to these two specific embodiments, it is not limited thereto as various alterations may be made without departing from the scope of the claims. The shape of the operating lever may vary substantially and any suitable form of hinge may be employed to enable the lever to be folded when not in use.

I claim:

1. A lever for lifting manhole covers comprising a foot, a key adapted to engage a key hole in a manhole cover, said key being pivotally mounted on one end of the foot, a first roller mounted on the foot inwardly of the other end thereof for rotation about an axis transverse to the longitudinal axis of the foot, a second roller mounted on the foot adjacent the other end thereof for rotation about an axis parallel to the axis of rotation of the first roller, the rollers being located relative to each other so that they function as a rolling fulcrum, the first roller functioning initially as a pivot for lifting the manhole cover and the second roller functioning as a trolley to enable the lifted cover to be transported and an operating lever one end of which is connected to the foot adjacent said one end with the lever projecting at an angle therefrom.

2. A lever for lifting manhole covers as claimed in claim 1 wherein a plurality of second rollers are mounted on the foot adjacent the other end thereof for rotation about an axis parallel to the axis of rotation of the first roller.

3. A lever for lifting manhole covers as claimed in claim 1 wherein the operating lever is formed of two or more sections, each section being hingedly fixed to the other to allow the said lever to be folded when not in use.

4. A lever for lifting manhole covers as claimed in claim 1 wherein the foot is provided in its central portion with an engaging and jacking device to break the seal of manhole covers.

5. A lever for lifting manhole covers as claimed in claim 4 wherein the engaging and jacking device comprises an adjustable tee bolt the longitudinal axis of which is transverse to the longitudinal axis of the foot, one end of said tee bolt being provided with an operating handle whilst the opposite end is fitted with a transverse key for engaging manhole covers, a screw or jack member is positioned parallel and adjacent to said tee bolt, operation of said jack member applies a downward pressure to portion of said manhole cover's surrounding framework thereby lifting said transverse key and breaking the seal of the manhole cover.

6. A lever for lifting manhole covers as claimed in claim 5 wherein the tee bolt is provided with a locking means to ensure that the transverse key remains in an engaged position during the seal breaking procedure.

7. A lever for lifting manhole covers as claimed in claim 3 wherein the operating lever is "Y" or yoke shaped.

8. A lever for lifting manhole covers as claimed in claim 1 wherein said operating lever comprises a pair of parallel spaced apart lever arms.

* * * * *